US009145716B2

(12) United States Patent
Jayasuriya et al.

(10) Patent No.: US 9,145,716 B2
(45) Date of Patent: Sep. 29, 2015

(54) DEPLOYABLE HOOD LATCH FOR PEDESTRIAN HEAD PROTECTION

(71) Applicants: Mangala A. Jayasuriya, Bloomfield Hills, MI (US); Iskander Farooq, Novi, MI (US); Mohammed Omar Faruque, Ann Arbor, MI (US); James Chih Cheng, Troy, MI (US); Allan Roy Gale, Livonia, MI (US)

(72) Inventors: Mangala A. Jayasuriya, Bloomfield Hills, MI (US); Iskander Farooq, Novi, MI (US); Mohammed Omar Faruque, Ann Arbor, MI (US); James Chih Cheng, Troy, MI (US); Allan Roy Gale, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 221 days.

(21) Appl. No.: 13/716,584

(22) Filed: Dec. 17, 2012

(65) Prior Publication Data

US 2013/0300134 A1 Nov. 14, 2013

Related U.S. Application Data

(60) Provisional application No. 61/644,725, filed on May 9, 2012.

(51) Int. Cl.

| | |
|---|---|
| ***E05C 3/16*** | (2006.01) |
| ***E05B 77/08*** | (2014.01) |
| ***E05B 83/24*** | (2014.01) |

(52) U.S. Cl.

CPC ..... *E05B 77/08* (2013.01); *E05B 83/24* (2013.01); *Y10T 292/0936* (2015.04)

(58) Field of Classification Search

CPC ..... E05B 77/08; E05B 83/24

USPC ..... 292/129, 92, 200, 201, 216, 196, 292/DIG. 65, 195, DIG. 23, DIG. 14, DIG. 4; 296/193.11, 187.04, 187.09; 180/69.2, 180/69.21, 274

See application file for complete search history.

(56) References Cited

U.S. PATENT DOCUMENTS

| | | | | | |
|---|---|---|---|---|---|
| 3,347,584 | A | * | 10/1967 | Johnstone | 292/198 |
| 3,504,511 | A | * | 4/1970 | Allen | 70/241 |
| 3,664,698 | A | * | 5/1972 | Stropkay | 292/201 |
| 3,917,330 | A | * | 11/1975 | Quantz | 292/216 |
| 4,262,830 | A | * | 4/1981 | Haves | 224/505 |
| 4,468,941 | A | * | 9/1984 | Bascou | 70/241 |
| 5,150,933 | A | * | 9/1992 | Myslicki et al. | 292/216 |
| 6,149,210 | A | * | 11/2000 | Hunt et al. | 292/216 |

(Continued)

FOREIGN PATENT DOCUMENTS

DE 102005060750 A1 * 6/2007

*Primary Examiner* — Kristina Fulton

*Assistant Examiner* — Christine M Mills

(74) *Attorney, Agent, or Firm* — Frank A. MacKenzie; Price Heneveld LLP

(57) ABSTRACT

A motor vehicle hood latch mechanism for engaging a striker of a hood having a closed locked position and a released position is disclosed. The mechanism includes a latch assembly attached to a chassis member. The latch assembly includes a latch having a locking cam and a pawl movable between a locked position engaging the locking cam and an unlocked position away from the locking cam. A sensor detects the presence of a pedestrian proximate the front of the motor vehicle and generates a signal in response thereto. A deployment spring having an energized position and a released position is retained in an energized position by a release mechanism responsive to the signal generated by the sensor, such that actuation of the release mechanism releases the resilient member and rotates the pawl to the unlocked position to release the latch.

13 Claims, 13 Drawing Sheets

(56) References Cited

U.S. PATENT DOCUMENTS

| | | | | |
|---|---|---|---|---|
| 7,296,830 | B2 * | 11/2007 | Koveal et al. | 292/201 |
| 7,461,872 | B2 * | 12/2008 | Moon et al. | 292/209 |
| 7,483,777 | B2 * | 1/2009 | Takahashi et al. | 701/45 |
| 7,559,399 | B2 * | 7/2009 | Lewis et al. | 180/274 |
| 8,104,803 | B2 * | 1/2012 | Horton et al. | 292/201 |
| 8,516,864 | B2 * | 8/2013 | Greiner et al. | 70/278.7 |
| 2006/0097522 | A1 * | 5/2006 | Denison et al. | 292/201 |
| 2007/0246944 | A1 * | 10/2007 | Sundararajan et al. | 292/92 |
| 2008/0224482 | A1 * | 9/2008 | Cumbo et al. | 292/216 |

* cited by examiner

DEPLOYABLE HOOD LATCH FOR PEDESTRIAN HEAD PROTECTION

FIELD OF THE INVENTION

The present invention generally relates to a hood latch for a motor vehicle, specifically a hood latch that is deployed in response to the sudden presence of a pedestrian in front of the vehicle while the vehicle is in motion.

BACKGROUND OF THE INVENTION

Latch assemblies for motor vehicles are generally well-known in the art. In most motor vehicles, a hood is used to enclose the engine or luggage compartment of the motor vehicle. Such hoods are typically situated so as to be opened from the front of the vehicle and hinged along a rearward edge, such that the hood opens from the front of the vehicle. The hood is typically equipped with a striker attached to the lower surface near the forward edge of the hood. The striker is situated to interact and to be restrained by the latch assembly attached to the motor vehicle chassis, likewise located proximate the forward edge of the hood. As is common in the industry, a latch release handle is typically situated in the occupant compartment, typically near the driver's side kick panel or under the instrument panel. The handle is typically connected via a bowden cable to a latch release lever operatively connected to a primary latch of the latch assembly. Upon actuation of the hood release handle in the occupant compartment, the bowden cable pulls on the latch release lever, thereby releasing the striker from the primary latch of the latch assembly.

A secondary hood latch is also common in such latch assemblies. Such secondary hood latches must be manually operated while in front of the vehicle, such that in the event of an inadvertent release of the primary latch handle or failure of the primary latch while the vehicle is in motion, the hood will not abruptly raise due to wind pressure. Rather, the secondary latch requires a person standing in front of the vehicle to manually operate the secondary latch to free the hood striker from the secondary latch of the latch assembly, thereby allowing the hood to be fully raised, providing access to the engine in the engine compartment and/or luggage within the luggage compartment.

In the context of such latch assemblies having primary and secondary hood latches, the deployment module disclosed herein addresses and solves the problem of pedestrian head injuries occurring in the event of a frontal impact by a motor vehicle. These head injuries are primarily caused by the pedestrian's head impacting the vehicle hood subsequent to the initial collision event. That is, pedestrians are generally hit at the legs first, with the body then rotating about an axis parallel to the vehicle lateral axis, followed by the head impacting the hood. However, given the trend to package engine components more efficiently within the engine compartment, very little clearance is provided between the lower surface of the motor vehicle hood and the upper rigid portions of the engine components, particularly such components as the intake manifold and air cleaning assemblies. Thus, in the event of an impact by the pedestrian's head against the hood, there is very little displacement that the hood can provide before encountering a substantially rigid structure that would prevent further deflection of the hood. Similarly, when a pedestrian's head impacts the edges of the hood, there is very little underhood clearance. Thus, the impact force and resulting trauma are magnified in the event of pedestrian injuries.

Heretofore, hood latch assemblies responsive to the presence of a pedestrian have been devised, although they experience certain drawbacks. For example, many prior art hood latch assemblies have rather complicated constructions, which are expensive to manufacture and difficult to repair. Such systems require a redesigned new latch to accommodate the desired function. Other systems have relatively large footprint that tend to obstruct air flow and cooling. Also, such prior art system suffer from higher part count, package complexity, weight, and cost. Hence, a hood latch assembly which overcomes these drawbacks would be advantageous.

The hood latch deployment module disclosed herein particularly accomplishes the foregoing by adapting the present typical motor vehicle latch assembly described above through an add-on module that can be applied to existing designs. The present invention takes advantage of existing structural configurations and uses a sensing device available in many vehicles today, such as radar or other sensing devices that might be used to detect the presence of a pedestrian in the front of the vehicle. At the onset of detecting a pedestrian in front of the vehicle while the vehicle is in forward motion, the sensing device generates a signal that is sent to an actuator, such as a solenoid, situated in and attached to the deployment module to release a resilient member, such as a torsion spring, that in turn releases the primary latch and raise the hood.

Thus, the solution presented by the present disclosure is a relatively low-cost, add-on latch deployment module that abruptly raises the hood by releasing the primary latch and raising the hood to the secondary latch position upon detection of the presence of a pedestrian in front of the vehicle while the vehicle is in forward motion, before the pedestrian head impacts the hood. In some vehicles, for example, the hood is raised approximately 25 mm at the front edge of the hood. When the pedestrian's head impacts the hood, the raised hood allows additional displacement and deflection, thereby absorbing and dissipating greater energy over a longer displacement, thus reducing the amount of force to and energy absorbed by the pedestrian's head and concurrently reducing the trauma to the pedestrian's head. Since the hood is allowed to deflect to a greater total displacement, a head impacting the hood will decelerate over a longer period of time, with lower deceleration levels resulting in less severe head injuries.

SUMMARY OF THE INVENTION

According to one aspect of the present invention, a motor vehicle hood latch mechanism for engaging a striker is disposed proximate an edge of a hood having a closed locked position and a primary released position, the mechanism comprising a latch assembly is attached to a chassis member of the motor vehicle and adapted to releasably engage the striker to restrain the hood in the closed locked position. The latch assembly includes a latch having a locking cam and a pawl movable between a latched (primary locked) position engaging a locking cam, wherein the latch secures the striker to restrain the hood in the closed locked position. The pawl also has a primary released position away from the locking cam, wherein the latch allows the hood to move to the primary released position. The present aspect of the invention employs a sensor for detecting the presence of a pedestrian proximate the front of the motor vehicle and generating a signal in response thereto along with a resilient member having an energized position and a released position operatively coupled to the pawl, the resilient member being retained in the energized position by a release mechanism responsive to the signal generated by the sensor, such that actuation of the release mechanism releases the resilient member and rotates the pawl to first disengage the primary lock of the latch and then to rotate the latch and lift the striker and hood to the primary released position.

Another aspect of the of the invention is a motor vehicle hood latch mechanism where the resilient member comprises a torsion spring having a center spring coil, an upper leg extending from an upper portion of the center spring coil and a lower leg extending from a lower portion of the center spring coil, and the release mechanism comprises a solenoid coupled to a holding pin to hold one of the upper and lower spring legs in the loaded position, wherein activation of the solenoid in response to the signal generated by the sensor releases the torsion spring to the released position and urges the pawl to the primary unlocked position.

Still another aspect of the present invention is a motor vehicle hood latch mechanism comprising a secondary latch restraining the hood in a partially open or primary released position subsequent rotation of the pawl to the primary unlocked position.

Yet another aspect of the present invention is a motor vehicle hood latch mechanism comprising a latch engagement stud mounted to the latch for engagement with one of the legs of the torsion spring and a latch pivot bolt about which the latch rotates and about which the coil spring is mounted, wherein activation of the solenoid in response to the signal generated by the sensor releases the one of the legs of the torsion spring for engagement with the latch engagement stud to rotate the latch and place the hood in the released position.

An additional aspect of the present invention is a motor vehicle hood latch mechanism where the latch comprises an upper segment having a transverse portion and a depending portion for engaging the striker and a lower segment to which the latch engagement stud is mounted, wherein when the latch is rotated to allow the hood to move to the primary released position, and wherein the striker is engaged by the depending portion of the upper segment to limit opening of the hood.

Another aspect of the present invention is motor vehicle hood latch mechanism comprising a secondary latch release lever and wherein the latch further comprises a secondary latch release pawl engaging tab for selective engagement with the pawl, wherein the latch secures the striker to restrain the hood in the primary released position and wherein operation of the secondary latch release lever further rotates the pawl so as to release the secondary latch release pawl engaging tab on the latch to completely disengage the latch from the striker allowing for fully opening the hood.

Still another aspect of the present invention is a motor vehicle hood latch mechanism comprising a pawl release lever operatively coupled with the pawl and a cam on the pawl release lever, wherein the one of the legs of the torsion spring acts directly on the cam on the pawl release lever to rotate the pawl release lever, and to rotate the pawl to the primary unlocked position.

A further aspect of the present invention is a motor vehicle hood latch mechanism where one of the legs of the torsion spring also acts directly on the latch engagement stud to rotate the latch to place the hood in the released position.

Yet a further aspect of the present invention is a motor vehicle hood latch mechanism where the torsion spring and solenoid are mounted to a module base attached to the latch assembly, the torsion spring being disposed about a spring mounting bushing in axial alignment with a latch pivot bolt about which the latch rotates, such that the lower leg of the torsion spring is disposed proximate the latch engagement stud and the upper leg of the torsion spring is restrained by the module base.

An additional aspect of the present invention is a motor vehicle hood latch mechanism comprising a pawl release lever operatively coupled with the pawl and a cam on the pawl release lever, wherein the resilient member acts directly on the cam on the pawl release lever to rotate the pawl release lever and the pawl to the primary unlocked position, and wherein the resilient member also acts directly on the latch engagement stud to rotate the latch to place the hood in the primary released position.

Yet another aspect of the present invention is a motor vehicle hood latch mechanism comprising a primary release lever operatively connected to the pawl, a pawl release lever operatively coupled with the pawl and a cam on the pawl release lever, wherein the resilient member acts directly on the cam on the pawl release lever to rotate the pawl release lever and the pawl to the primary unlocked position, and wherein the pawl release lever also acts on the primary release lever to rotate the latch to place the hood in the released position.

A still further aspect of the present invention is a motor vehicle hood latch mechanism comprising a pawl release lever operatively coupled with the pawl and a cam on the pawl release lever, wherein the resilient member acts directly on the cam on the pawl release lever to rotate the pawl release lever and the pawl to the primary unlocked position, and to rotate the latch to place the hood in the primary released position.

Another aspect of the present invention is a motor vehicle hood latch mechanism comprising a pawl release lever operatively coupled with the pawl and a cam on the pawl release lever, wherein the resilient member acts directly on the cam on the pawl release lever to rotate the pawl release lever and the pawl to the primary unlocked position, and to rotate the latch to the primary released position, and wherein the resilient member also acts on the striker to raise the hood to the primary released position.

A yet additional aspect of the present invention is a motor vehicle hood latch mechanism comprising a pawl release lever operatively coupled with the pawl and a cam on the pawl release lever, wherein the resilient member, release mechanism and pawl release lever are mounted to a module base attached to the latch assembly such that the resilient member acts directly on the cam on the pawl release lever to rotate the pawl release lever and the pawl to the primary unlocked position, and to rotate the latch to a primary released position, and wherein the resilient member also acts on the striker to raise the hood to the released position.

A further aspect of the present invention is a motor vehicle hood latch mechanism comprising a secondary release latch restraining the hood at a primary released position and a secondary latch release handle.

According to another aspect of the present invention, an add-on deployment module for attachment to a latch assembly for a motor vehicle hood latch mechanism having a striker disposed proximate an edge of a hood having a closed locked position and a released position, wherein the latch assembly is attached to a chassis member of the motor vehicle and is adapted to releasably engage the striker to restrain the hood in the closed locked position, the latch assembly including a latch having a locking cam and a pawl movable between a latched (primary locked) position engaging the locking cam, wherein the latch secures the striker to restrain the hood in the closed locked position, and a primary unlocked position away from the locking cam, wherein the latch allows the hood to move to the released position, the motor vehicle further having a sensor for detecting the presence of a pedestrian proximate the front of the motor vehicle and generating a signal in response thereto, the module comprising a module base; a resilient member having an energized position and a released position, the resilient member being retained in the energized position by a release mechanism responsive to the signal generated by the sensor, such that actuation of the release mechanism releases the resilient member; and a pawl release lever operatively coupled with the pawl and a cam on the pawl release lever, wherein the resilient member, release mechanism and pawl release lever are mounted to the module base attached to the latch assembly such that the resilient member acts on the cam on the pawl release lever to rotate the pawl release lever and the pawl to the primary unlocked position, and to rotate the latch to place the hood in the released position.

Still another aspect of the present invention is an add-on deployment module where the resilient member is a torsion spring in direct contact with the latch.

Yet another aspect of the present invention is an add-on deployment module where the resilient member is a torsion spring in direct contact with the striker.

According to another aspect of the present invention, a hood assembly for a motor vehicle comprises a latch having a locking cam engaging a striker disposed proximate an edge of the hood, a pawl selectively engaging the locking cam; a sensor generating a signal indicative of a pedestrian in front of the motor vehicle, a release mechanism responsive to the signal, and a spring urging the pawl to disengage from the locking cam when released by the release mechanism.

According to a further aspect of the present invention, a method of latching the hood of a motor vehicle hood having a striker disposed proximate an edge of a hood and having a closed locked position and a released position comprising the steps of: attaching a latch assembly to a chassis member of the motor vehicle proximate the striker for releasably engaging the striker to restrain the hood in the closed locked position, the latch assembly including a latch having a locking cam and a pawl movable between a latched position engaging the locking cam, wherein the latch secures the striker to restrain the hood in the closed locked position, and a primary unlocked position away from the locking cam, wherein the latch allows the hood to move to the released position, providing a resilient member having an energized position and a released position; providing a release mechanism having a rest state and an actuated state, wherein the resilient member is maintained in the energized position when the release mechanism is in the rest state and the resilient member is placed in the released position when the release mechanism is in the actuated state; detecting the presence of a pedestrian proximate the front of the motor vehicle and generating a signal in response thereto; and releasing the resilient member in response to the signal generated by the sensor, such that the release mechanism is placed in the actuated state and releases the resilient member to rotate the pawl to the primary unlocked position to place the hood in the released position.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 3:
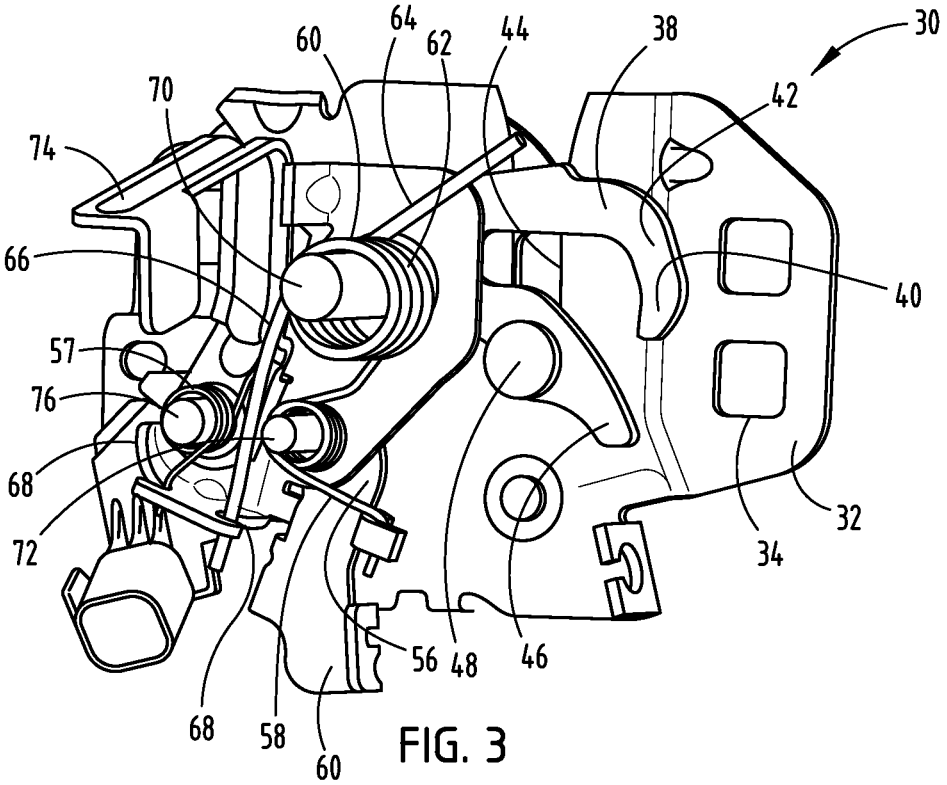
FIG. 3 is a front perspective view of the hood latch of the present invention with the latch placed in the locked position.

For purposes of description herein, the terms "upper," "lower," "right," "left," "rear," "front," "vertical," "horizontal," and derivatives thereof shall relate to the invention as oriented in FIG. 3. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
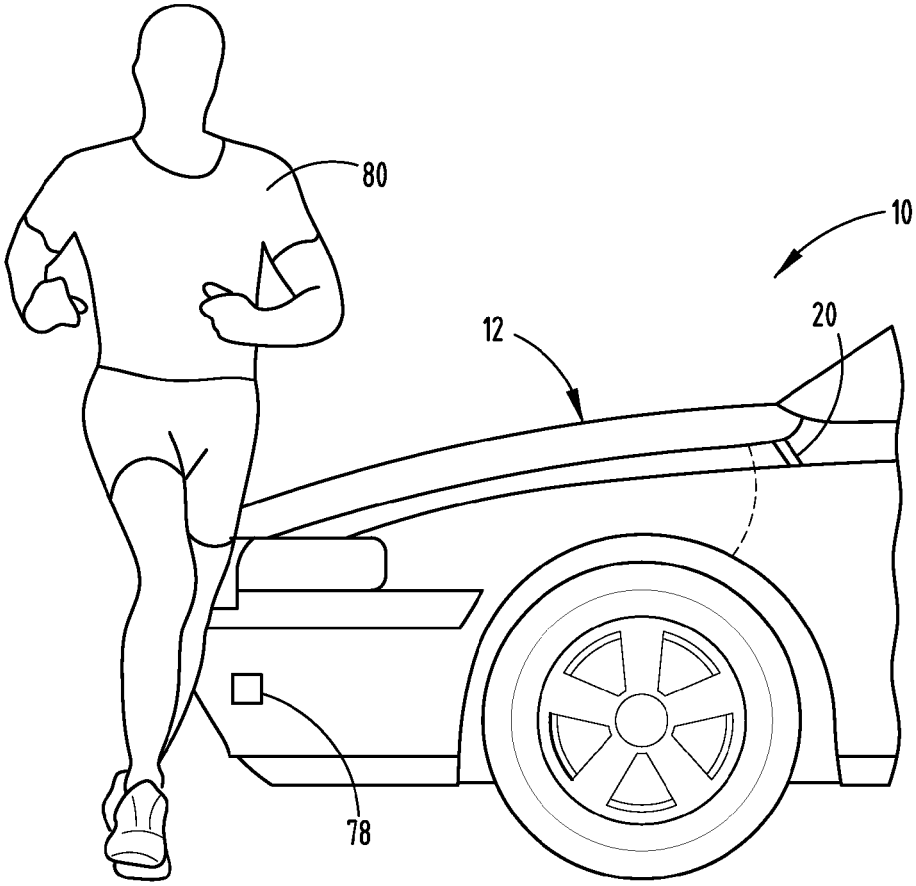
FIG. 1 is a side plan view of a motor vehicle incorporating the hood latch in accordance with the present invention.
Figure 2:
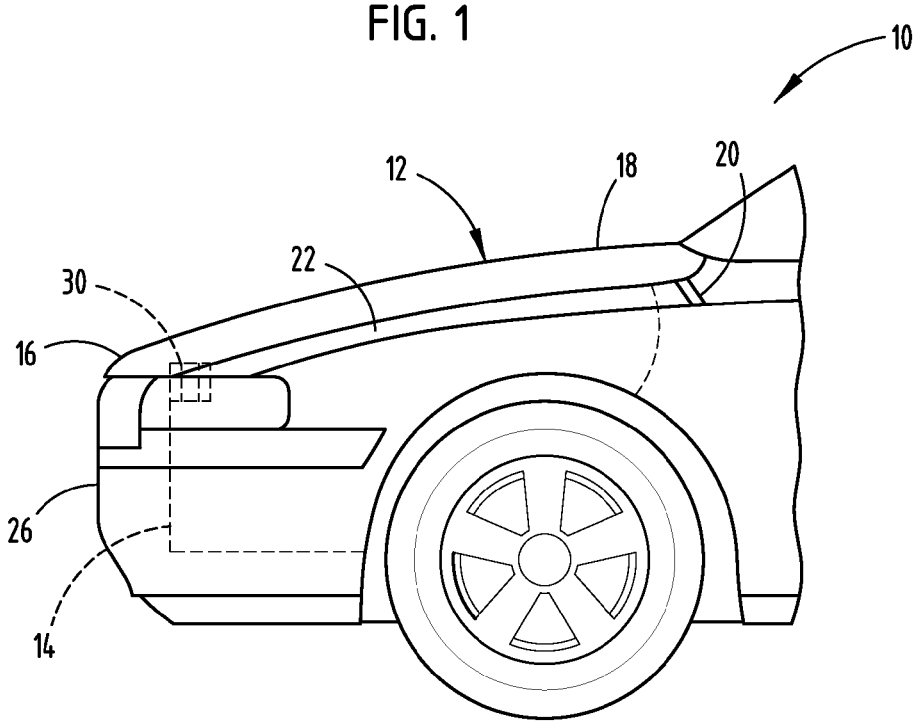
FIG. 2 is a side plan view of a motor vehicle incorporating the hood latch in accordance with the present invention.

Vehicle 10 includes a hood 12 covering an engine compartment 14. Hood 12 is generally formed as a panel having a forward edge 16 and a rearward edge 18. Hood 12 may be connected to the body of the vehicle 10 by hinges 20. In the closed position shown in FIGS. 1 and 2, hood 12 is disposed adjacent and extends across an opening 22 in the body of vehicle 10, providing access to an engine compartment 14. Hood 12 is releasably connected to the vehicle body 10 by a latch assembly 30 and is pivotable relative to the vehicle body to move between an open position and a closed position.

In the described example, it is assumed that latch assembly 30 may be located adjacent the forward edge 16 of the hood and the hinges 20 may be located at the rear edge 18 of hood 12. However, it is also possible to perform the functions of this invention while positioning the hinges adjacent the leading edge of the hood and the latch mechanism adjacent the trailing edge of the hood.

Vehicle 10 may be provided with a deformable forward section 26 extending generally forward of the leading edge 16 of hood 12 and engine compartment 14. It is contemplated that the forward section 26 will deform upon contact with an object in a collision to absorb the impact force associated with the collision. It is also contemplated that the forward edge 16 of the hood 12 may be designed to allow for deformation upon impact with an object should the vehicle not include a deformable forward section.

Referring now to FIGS. 3-12, a first embodiment of the latch assembly 30 is shown, which generally show an existing hood latch for a motor vehicle. The hood latch includes a bracket 32 attached via mounting holes 34 to a front chassis member or base via fasteners (not shown) extending transverse parallel to the lateral axis of the motor vehicle, as is well-known in the art. The latch assembly 30 interacts with a striker 36 disposed on the forward edge 16 of the hood 12 relative to the motor vehicle. The hood 12 has a closed locked position, a released position, and an open position. In the closed locked position, seen in FIG. 5A, the hood 12 cannot be raised and is restrained in place by a latch 38 capturing and restraining the striker 34. The latch 38 has a primary latch portion 40 extending transversely and a secondary latch portion 42 depending from the primary latch portion 40 normal to the primary latch portion 40 and extending in a downward direction to create a hook-shaped structure. In the release position, best seen in FIG. 5B, the primary latch 40 is released, but the secondary latch 42 is not, thereby allowing the hood 12 to be raised, typically 25 mm. In the open position, best seen in FIG. 5C, both the primary and the secondary latches 40, 42 are in the open position and the hood 12 may be raised as described previously. The primary latch 40 restrains the hood in the closed locked position within a channel 44 configured to receive the striker 36, as shown. In the embodiment shown, the latch 38 also includes a lower portion 46 to which a latch engagement stud 48 is attached, as will be described further below.

Figure 5A:
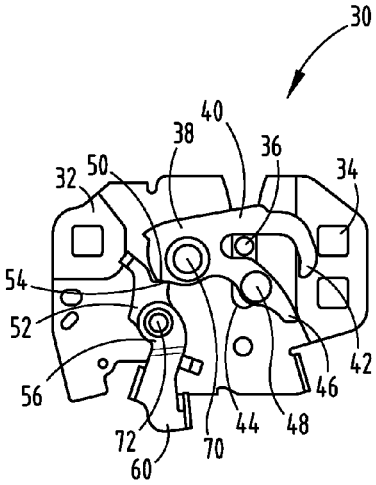
FIG. 5A is a front plan view of the hood latch of the present invention in the locked position.
Figure 5B:
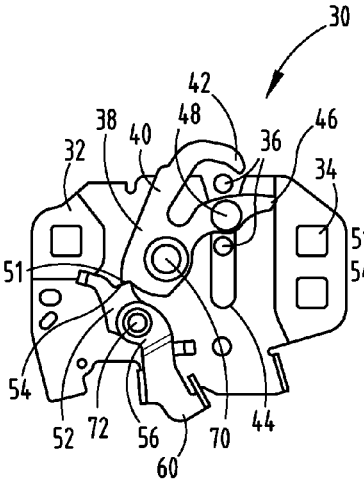
FIG. 5B is a front plan view of the hood latch of the present invention in the released and partially open position.
Figure 5C:
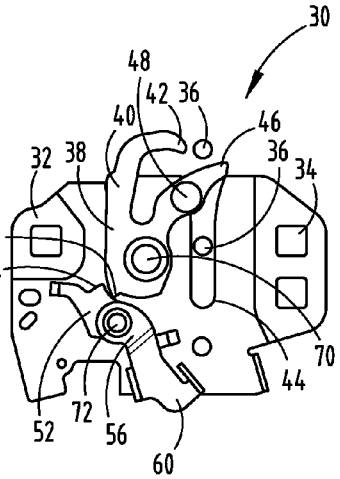
FIG. 5C is a front plan view of the hood latch of the present invention in the open position.

The latch 38 further includes a pawl engaging primary latch tab 50 and secondary latch tab 51 adapted for interaction with a pawl 52 pivotally mounted to the bracket 32 to receive and engage the primary latch tab 50. The pawl 52 has a latch cam engaging surface 54 and is operatively coupled with a primary release lever 56. The pawl and primary release lever 56 are urged into contact with the latch 38 via pawl torsion spring 58. A distal end 60 of the primary release lever 56 is connected to a bowden cable (not shown) that, as described above, is in turn connected to the hood latch release lever inside the occupant compartment. A latch torsion spring 62 is provided about the pivot bolt axis 70 of the latch 38. The latch torsion spring 62 has a upper leg 64 and lower leg 66. The upper leg is disposed adjacent the latch engagement stud 48, while the lower leg 66 is restrained in a lower notch 68 in the bracket 32. The torsion spring 62 thus urges the latch 38 into a counterclockwise rotation (as shown in FIGS. 5A-5C) about latch pivot bolt 70, causing the latch 38 to raise from the closed locked position to the release position and ultimately to the unlocked position.

The pawl spring 58 is situated below the latch pivot bolt 70 about a pawl spring bolt 72 and operates to urge the primary release lever 56 and the mechanically coupled pawl 52 into successive engagement with the primary and secondary latch tabs 50, 51 relative to the pawl engaging surface 54 of the pawl 52. That is, in the closed locked position, the primary latch 40 engages and captures the striker 38 within the channel 44. The primary latch tab 50 of the latch 38 is engaged by the latch cam engaging surface 54, with both being urged into contact with one another. As the bowden cable is actuated, the primary release lever 56 is rotated counterclockwise, as seen in FIG. 5A, causing the pawl 52, also rotatably mounted about the pawl spring pivot bolt 72, to rotate in the counterclockwise direction as well, thereby removing the pawl 52 from engagement with the pawl engaging tab 50 of the latch 38. Thus, urged by the latch spring 62, the latch 38 likewise rotates in a counterclockwise direction to the first released position shown in FIG. 5B. As the striker 36 is caught between the secondary latch 42 and the lower portion 46 within the channel 44, the striker 36 is likewise placed within the latch assembly to a released position within the bracket 32. While in the release position just described, the striker 36 is nonetheless restrained by the secondary latch 42 such that it is unable to exit from the channel 44 and is thereby restrained by the latch 38 from any further travel by the latch cam engaging surface abutting the secondary latch tab 51. However, as a consequence of having traveled upwards, the striker is, along with the forward edge of the hood 12, raised approximately 25 mm above its original position.

In normal operation, a secondary release handle 74 is rotatably mounted about a secondary release handle pivot bolt 76 and is displaced in a counterclockwise manner and further engages the pawl 52 to cause the latch cam engaging surface 54 to move away from the secondary latch tab 51 on the latch 38, thus releasing the latch 38 to further rotate counterclockwise, thereby causing the secondary latch 42 to no longer impede the upward portion of the striker 36. Further, with this rotation of the latch 38, the lower portion 46 of the latch 38 urges the striker 36 in an upward direction so that the striker 36 is free of the latch assembly 30. The hood 12 may be freely opened.

Figure 4:
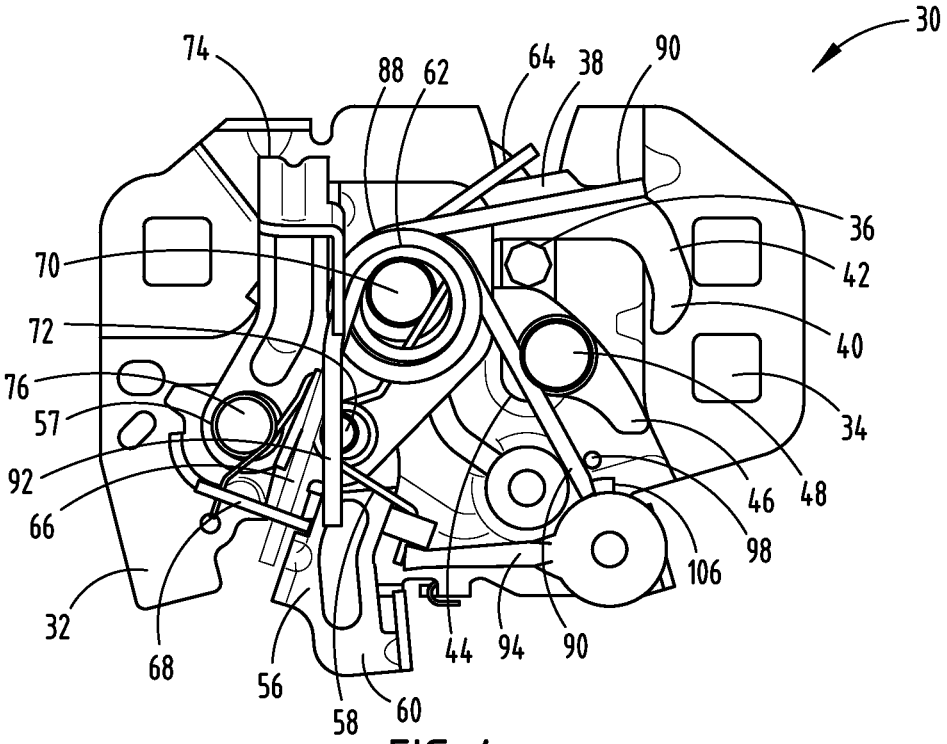
FIG. 4 is a front plan view of the hood latch of the present invention with the latch placed in the locked position.
Figure 10:
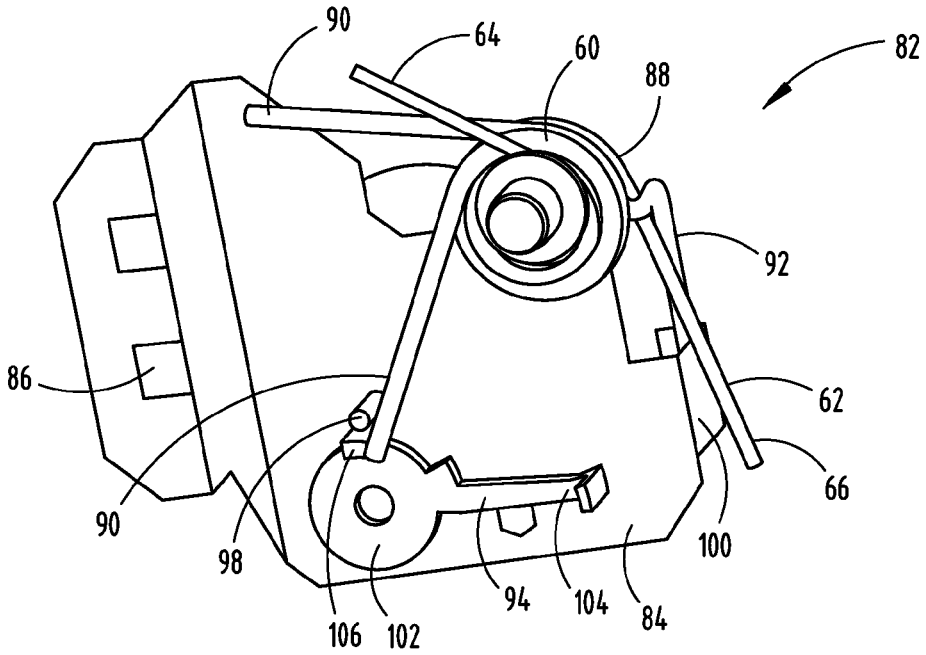
FIG. 10 is a rear perspective view of the attachable deployment module of the hood latch of the present invention.
Figure 11:
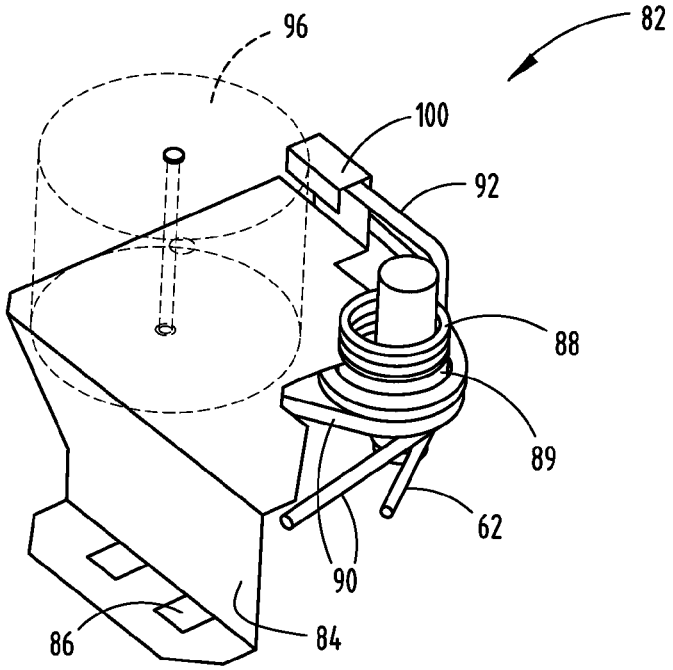
FIG. 11 is a front perspective view of the attachable deployment module of the hood latch of the present invention.
Figure 12:
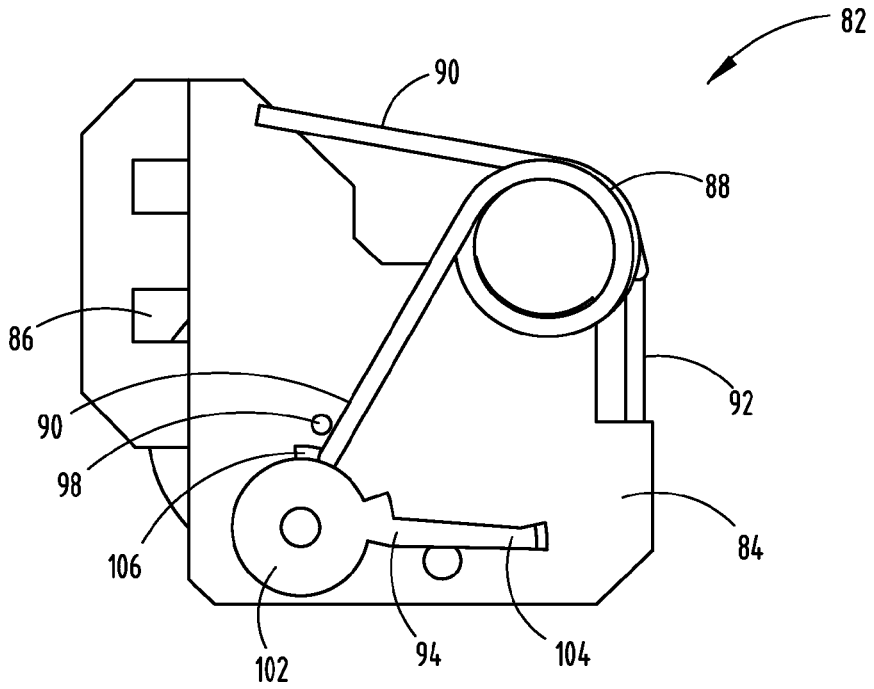
FIG. 12 is a rear plan view of a the attachable deployment module of the hood latch of the present invention.
Figure 13:
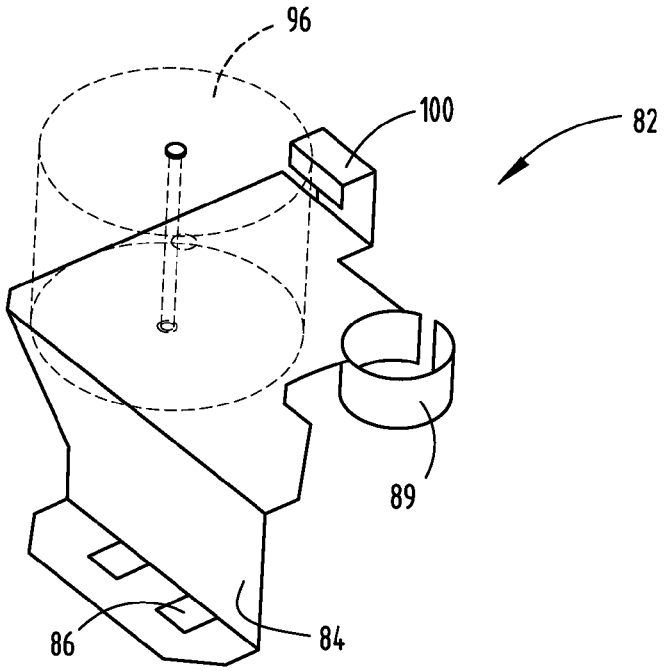
FIG. 13 is a rear perspective view of the attachable deployment module of the hood latch of the present invention.

In the context of the present disclosure, the latch assembly 30 as described above may be combined with a deployment module 82 (best shown in FIGS. 10-13) that includes an attachment bracket 84 that attaches via mounting holes 86 to the latch bracket. The deployment module 82 includes a deployment spring 88 having an upper leg 90 and a lower leg 92, a pawl release lever 94, and an actuator or a solenoid 96 having its shaft engaging holding pin 98 directly or via a lever mechanism, as discussed below, and extending into the latch assembly 30. As shown in FIGS. 4 and 11, the deployment spring 88 is positioned about a spring bushing 89 on the attachment bracket 84 such that the upper leg 90 may urge against the latch engagement stud 48 on the lower portion 46 of the latch 38 and the upper leg 90 is restrained by a spring retainer 100. (The upper leg 90 is shown in both the closed and released positions in the FIGS. 4, 10, and 12.) As shown, the axis of bushing 89 is coaxial with the pivot bolt axis 70 about which the latch 38 pivots, but can be mounted on a pivot other than that coincident with the latch. When in the energized state, the upper leg 90 of the deployment spring 88 is restrained from further motion by the holding pin 98, which is directly or via a lever mechanism attached to the solenoid 96, extending through the attachment bracket 84 at a 90° angle to the direction of movement of the upper leg 90 in contact with the holding pin 98. Preferably, the deployment module 82 is assembled with the deployment spring in its energized position and secured by the module attachment bracket 84 at the lower leg 92 and holding pin 98 at the upper leg 90.

As noted above, the solenoid 96 has a shaft engaging holding pin 98 extending into the latch assembly 30. As shown in FIG. 10, the holding pin 98 directly extends into the latch assembly 30 through the use of a retractable solenoid shaft. However, other types of actuators, configurations, and geometries may be used to control the activation rates for the present system. For example, the solenoid 96 might be arranged to activate the system by a retractable or extendable solenoid shaft that interacts with another member, such as a lever (not shown). That is, the holding pin 98 need not act directly on the upper leg 90 of the deployment spring 88 to restrain the upper leg 90 from further motion and engaging the latch engagement stud 48. Rather, a lever mechanism having discrete displacements can be used in combination with a solenoid shaft to hold the upper leg 90 until the signal occurs to release the upper leg 90 to obtain a faster response interval.

Figure 6:
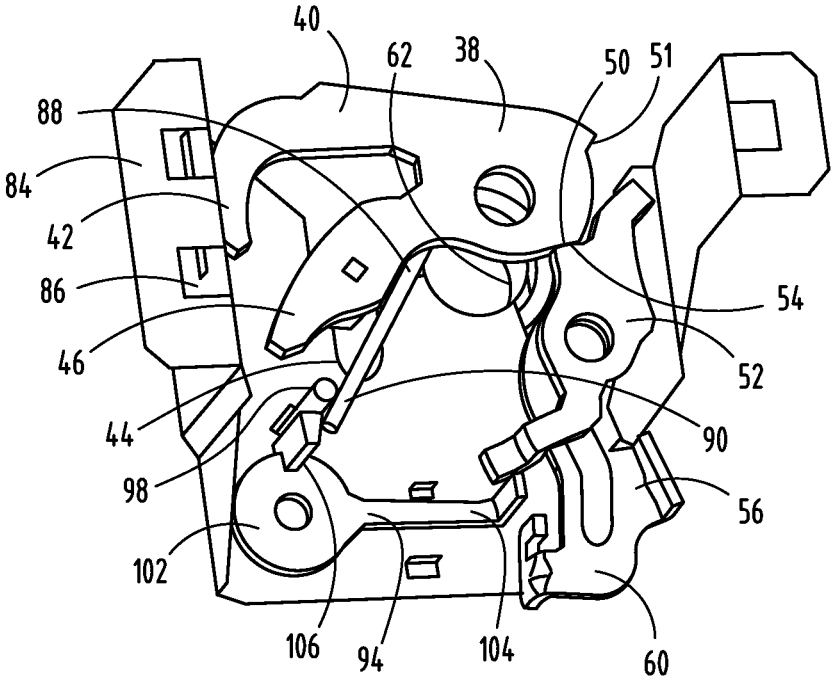
FIG. 6 is a rear perspective view of the pawl release lever of the hood latch of the present invention in the locked position and attached to the attachable deployment module.
Figure 7:
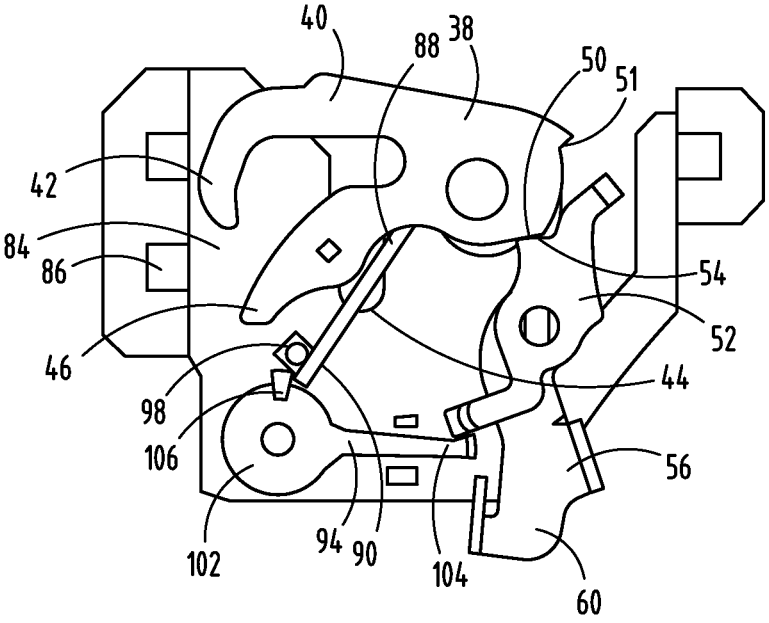
FIG. 7 is a rear plan view of the pawl release lever of the hood latch of the present invention in the locked position and attached the attachable deployment module.
Figure 8:
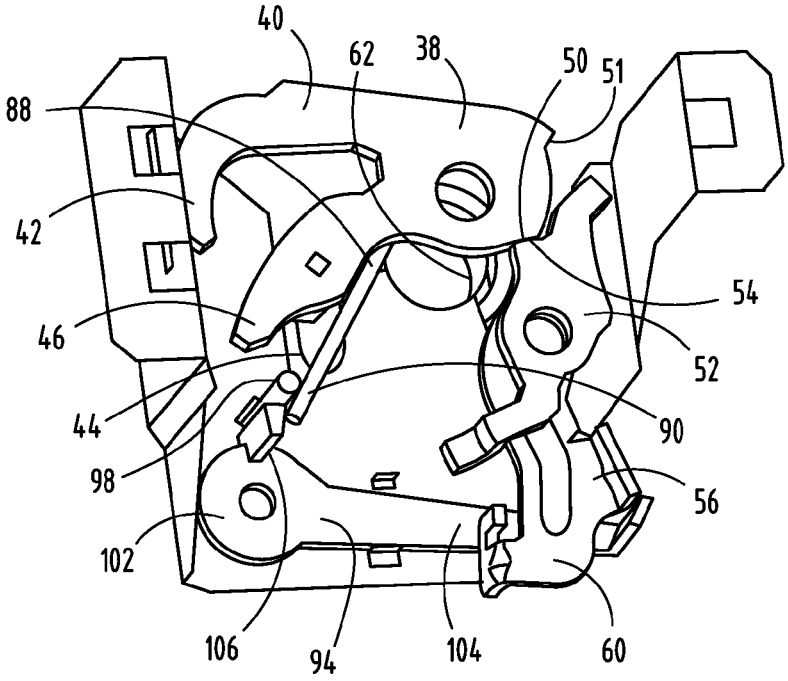
FIG. 8 is a rear perspective view of another embodiment of the pawl release lever of the hood latch of the present invention in the locked position and attached to the attachable deployment module.
Figure 9:
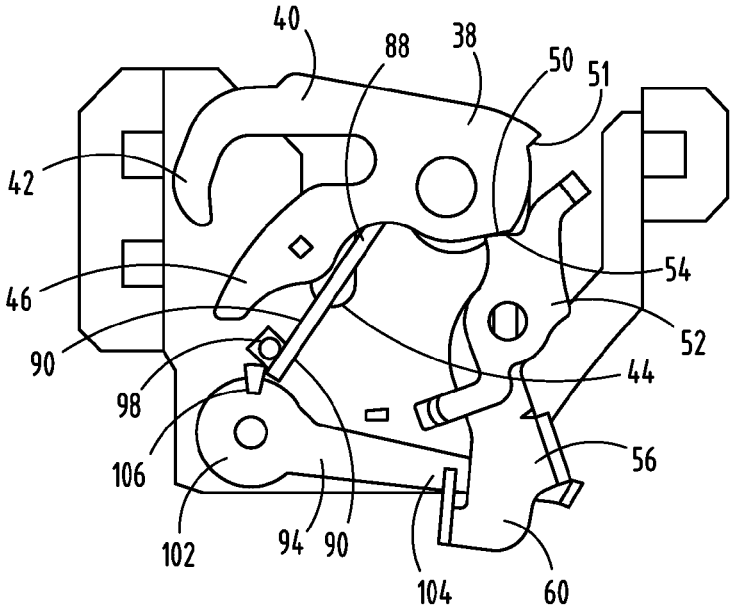
FIG. 9 is a rear plan view of another embodiment of the pawl release lever of the hood latch of the present invention in the locked position and attached to the attachable deployment module.

The pawl release lever 94 pivotally mounted on the attachment bracket 84 has a circular portion 102 and an extending lateral portion 104. The circular portion 102 of the pawl release lever 94 also is provided with a release cam 106. In one embodiment, the lateral portion 104 extends away from the circular portion 102 so as to contact the pawl 52, as shown in FIGS. 6 and 7. In another embodiment, the extending lateral portion 104 extends to the opposite side of the primary release lever 56, as shown in FIGS. 8-9, to act upon the primary release lever 56 to in turn rotate the pawl 52 as described above. In either embodiment, a release cam 106 of the pawl release lever 94 is situated proximate the holding pin 98.

The motor vehicle includes one or more crash sensors 78 which sense an impact condition and transmit a signal to latch assembly 30 is described herein. In operation, the crash sensors 78 detect the presence of a pedestrian 80. Upon the vehicle's control system receiving the information that a pedestrian is about to be or has been hit by the motor vehicle, the motor vehicle control system generates a signal that is sent to the solenoid 96. Upon receiving the signal, the solenoid 96 activates and retracts the holding pin 98, thereby allowing the upper leg 90 of the deployment spring to act against and urge release cam 106 to a release position during the first few degrees of rotation. This motion rotates the pawl release lever 94 to engage either of the pawl 52 or the primary release lever 56, as discussed above, to cause the pawl 52 to rotate and the primary latch tab 50 to disengage from the latch cam engaging surface 54, causing the latch 38 to rotate violently in the counterclockwise direction (as seen in FIGS. 5A-5B) to the released position. At the same time, the upper leg 90 of the deployment spring engages the latch engagement stud 48, thereby rotating the latch 38 to the position shown in FIG. 5B, and thus to its release and raised position. The upper leg 90 of the deployment spring 88, mounted on the same latch pivot bolt as the latch spring 62, is preferably provided with sufficient stiffness and stored energy to encounter and raise the striker 36 and hood 12.

The raised hood 12 thus provides the necessary clearance of the additional deflection of the hood to otherwise reduce trauma injury to pedestrians that might strike it. Given that the entire operational sequence of the present deployment module takes roughly 30 milliseconds from initial sensing to the hood being raised up to 25 mm to the release position, the pedestrian's head hitting the hood within a 50 millisecond window, at a vehicle velocity of 60 kph or less, allows an improved result from such an injury. Thus, the amount of deflection that is allowed to occur in the hood is significantly increased, thus reducing the amount of energy that is transmitted to the pedestrian's head as a consequence of the pedestrian's head impacting the hood and consequent trauma to the pedestrian is reduced.

An advantage of the present system is that an add-on hood deployment module 82 can be added to an existing latch assembly 30 to release the pawl and rotate the latch to lift the striker 36 about 25 mm in a 30 millisecond time range. The normal operation of the existing latch assembly 30 will not be affected by the module 82, and the module 82 will only be activated when a pedestrian impact is identified by the crash sensors 78. Alternatively, the system of the present disclosure can be incorporated into the overall latch assembly 30.

A further advantage of the present system is a deployment module 82 that requires minimum package volume and therefore has a minimum footprint normal to the vehicle front plane. In this regard, the deployment spring 88 can be of any construction, but is preferably a rotational spring made of a round wire, a flat wire, that is, a square or rectangular section wires. This provides the greatest packaging advantage and efficiency of the present system and further lowers the size of the module 82. Similar systems with linear springs will have larger footprints and will require significantly more package space. Also, the solenoid 96 only needs to activate and retract the holding pin 98 to release the energized torsion deployment spring 88, and therefore requires less power. This in turn reduces the size of the solenoid 96 and makes the deployment module 82 easier to package. Preferably, the solenoid 96 is no larger than two (2") inches in diameter and one (1") inch in height (excluding the holding pin 98).

Further, a highly desirable feature of the deployment module 82 disclosed is that it is readily tunable to adjust stiffness and force levels as required for applications across vehicle lines by adjusting the spring rates of the various resilient components. That is, the torque spring rates may be modified to adjust the deployment speed faster or slower depending upon the other components. Additionally, the solenoid 96 can be selected from any number of different response curves, so that the holding pin 98 is withdrawn at a rate sufficient to accomplish the benefits of the present invention. It should be noted that devices other than a solenoid 96 can be used to trigger the latch assembly 130. Such devices include other electromechanical, servo, or pyro devices, or any other device that is adapted to actuate a mechanical system abruptly. Preferably, it has been found that the stroke of the solenoid 96 should be roughly 10 to 15 mm. This displacement obtains effective retraction in less than 15 milliseconds and generates a force of roughly 20 to 30 pounds. Further, the stiffness of the deployment spring 88 and the angle at which it is placed as its energized state determines how fast the striker 56 and the hood 12 will move up. Of course, the actual lift of the striker 36 and hood 12 is limited by the travel allowed by the secondary latch 42.

As noted above, the deployment module 82 can be added on or integrated into the base latch assembly 30. Also, after deployment, resetting the device can be performed either manually or automatically using an electrical gear motor or other similar device. That is, the deployment module 82 can be easily reset after any actual or accidental deployment to reinstall the deployment spring 88 to its energized position. It should also be noted that the deployment spring 88 can be used to engage either the latch (via the latch engagement stud 48), as discussed above, or to directly engage the striker 36 to lift the hood during deployment, as discussed below.

Figure 25:
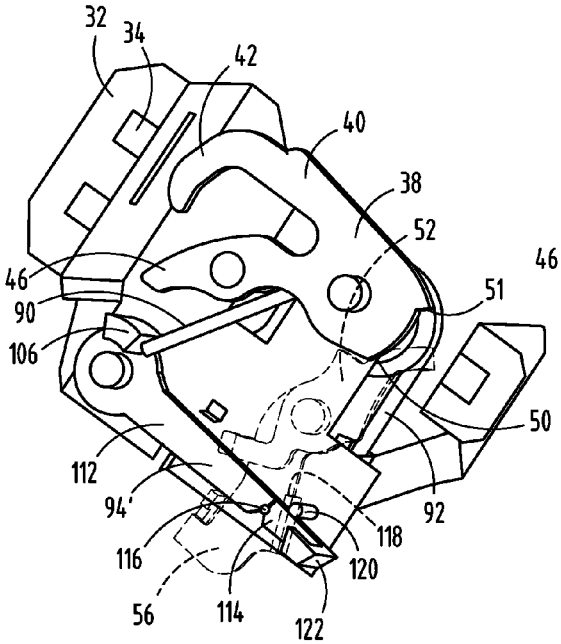
FIG. 25 is a rear perspective view of an additional embodiment of the pawl release lever of the hood latch of the present invention in the locked position.
Figure 26:
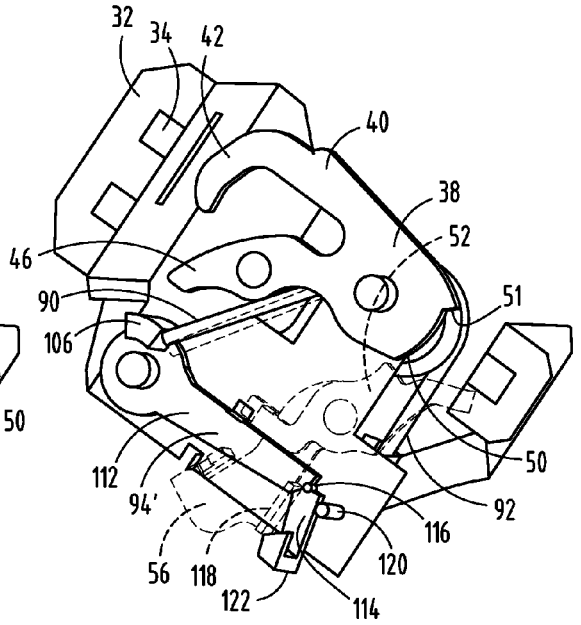
FIG. 26 is a rear perspective view of an additional embodiment of the pawl release lever of the hood latch of the present invention in the released position.

An alternative construction for the pawl release lever 94' is shown in FIGS. 25 and 26. As shown, the pawl release lever 94' consists of a pawl body portion 112 and a pawl hinged end portion 114 coupled one to the other via a hinge 116. As can be seen in FIG. 25, pawl release lever 94' is longer than pawl release lever 94, such as shown in FIG. 6, and extends to an external tab 118 on the distal end 60 of the primary release lever 56. A stud 120 is mounted to bracket 84. When the solenoid 96 is engaged and the retractable shaft 98 is withdrawn, the upper leg 90 of the deployment spring 88 is urged against release lever cam 106 to cause the pawl release lever 94' to rotate counterclockwise, thus bringing the pawl hinged end portion 114 to bear against stud 120, which in turn causes the pawl hinge end portion 114 to rotate clockwise about the hinge 116. In so doing, a tab 122 on the pawl hinge end portion 114 is caused to bear against tab 118 on primary release lever 56 and to cause the primary release lever 56 to rotate clockwise and against the pawl 52 to release the latch assembly 30 as described above.

The longer pawl release lever 94' may in some applications provide advantages over a shorter length. For example, due to the longer length, less force is needed to release the primary release lever 56. This, in turn, allows the use of a less forceful spring and smaller solenoid, which, in turn, allows for a smaller package space for the solenoid and module 82. Also, the longer pawl release lever 94' is more reliable.

In an additional embodiment, the latch 138 of a latch assembly 130 does not have a secondary release position as described in the previous embodiment. As shown in the FIGS. 14-24, the latch 138 similarly rotates around a latch pivot bolt 170. However, in the embodiment shown, the latch 138 is provided with an upper latch leg 140 that includes a transverse portion 142 that extends upwardly and away from a channel 144 provided in the latch bracket 132 for engaging and capturing the striker 36 of the hood 12. The latch bracket 132 is similarly provided with mounting holes 134 for attachment to a laterally transversing chassis body member (not shown).

Figure 14:
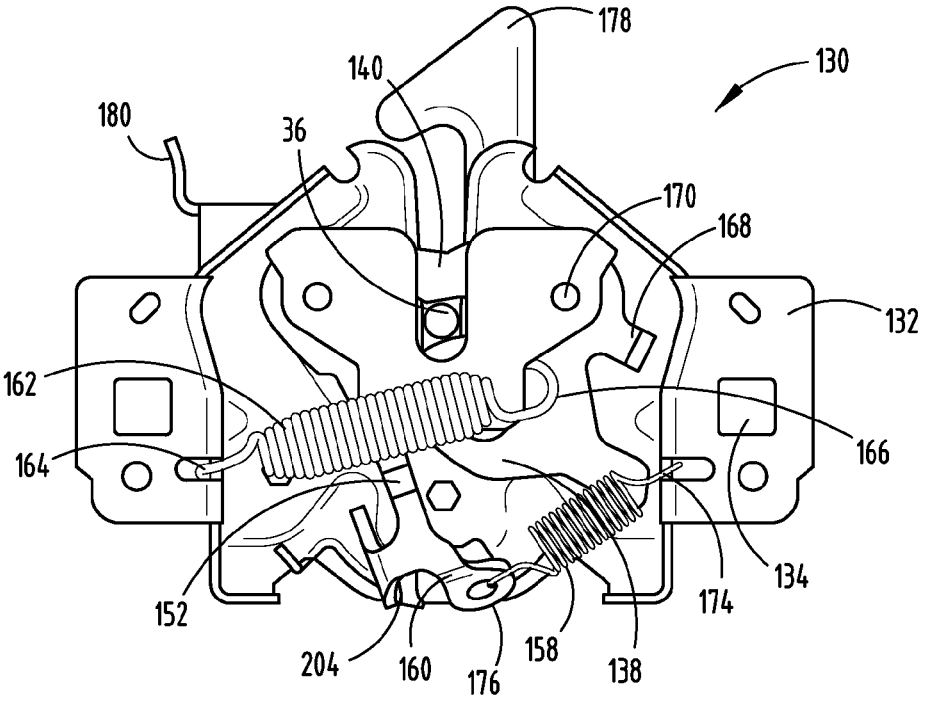
FIG. 14 is a rear plan view of another embodiment of the hood latch of the present invention in the locked position.
Figure 15:
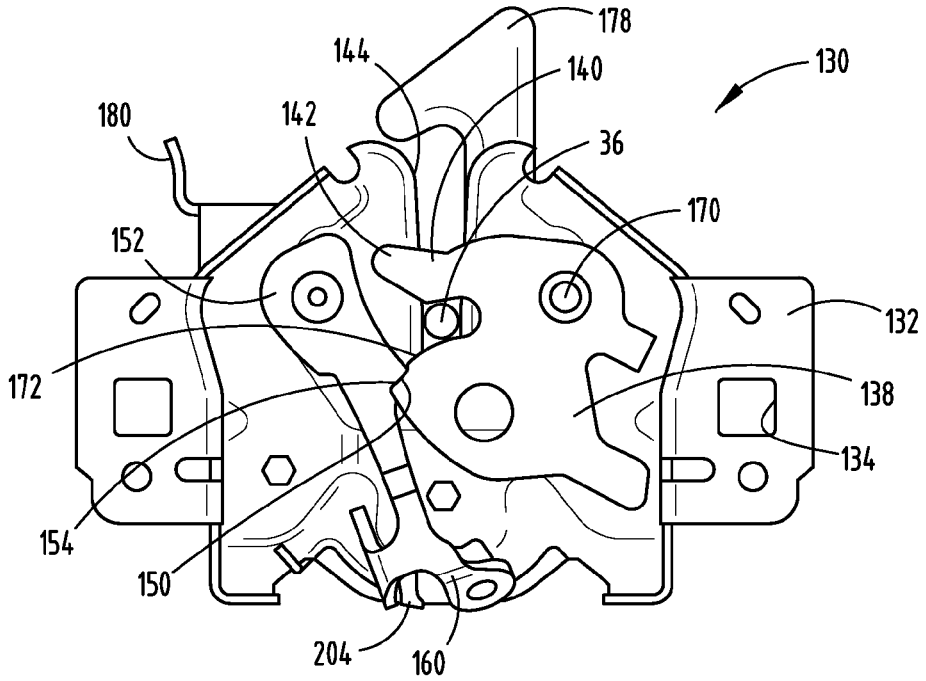
FIG. 15 is another rear plan view of another embodiment of the hood latch of the present invention in the locked position.
Figure 16:
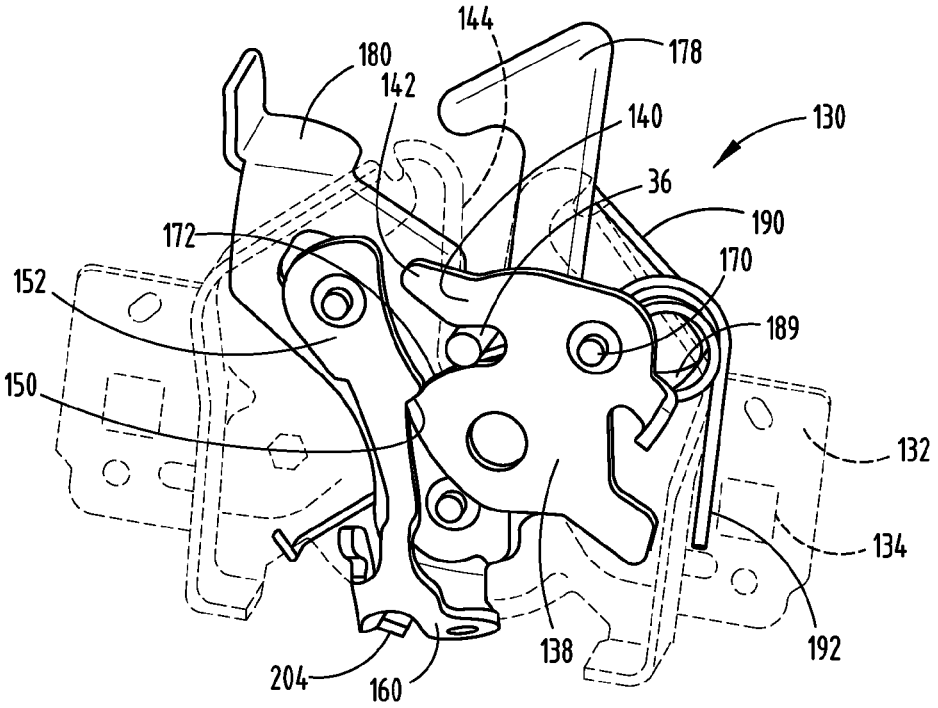
FIG. 16 is a rear perspective view of another embodiment of the hood latch of the present invention in the locked position.
Figure 17:
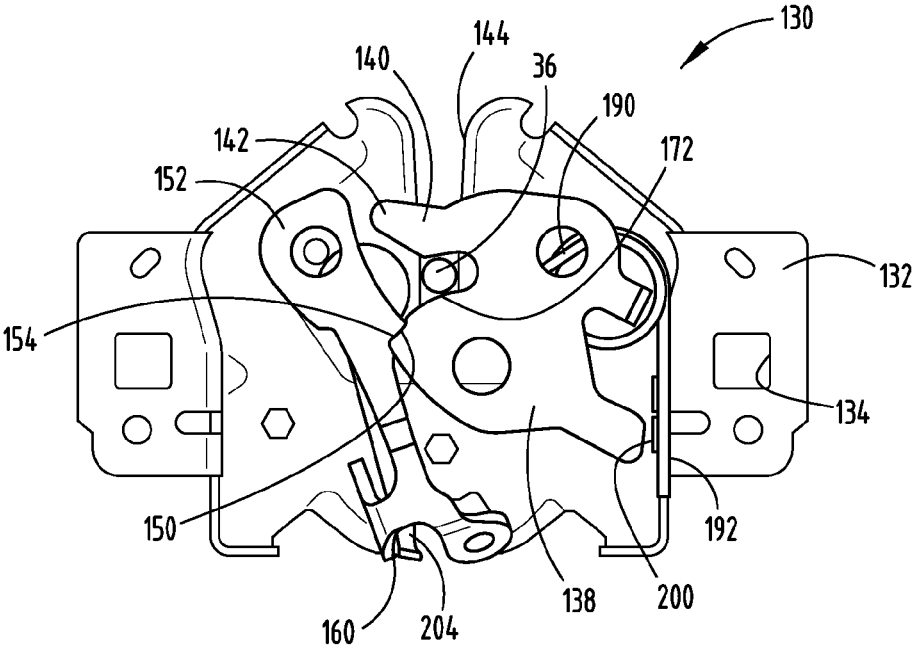
FIG. 17 is a rear plan view of certain components of another embodiment of the hood latch of the present invention in the locked position.

The latch 138 is provided with only a single pawl engaging tab 150 for engaging the latch cam engaging surface 154 of the pawl 152 of the latch assembly 130. The distal end 160 of pawl 152 is connected to a bowden cable (not shown) in the manner similar to that described above and the latch cam engaging surface 154 of the pawl 152 is urged into contact with the pawl engaging tab 150 by pawl spring 158 acting on pawl 152 to rotate the pawl 152 counterclockwise and by latch spring 162 acting on latch 138 to rotate the latch 138 clockwise, as best seen in FIGS. 14 and 15. As shown, pawl spring 158 has a first end 174 attached to the bracket 132 and an opposite second end 176 attached to the distal end 160 of the pawl 152. Latch spring 162 likewise has a first end 164 attached to the bracket 132 and an opposite second end 166 attached to a latch spring mounting ear 168 (shown not connected) provided on the latch 138.

Figure 23A:
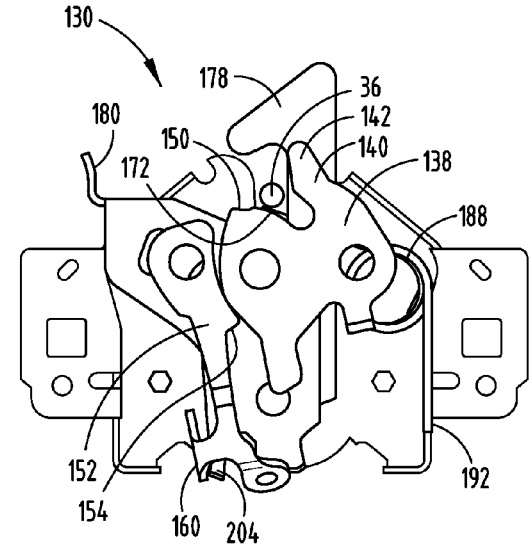
FIGS. 23A-23B are rear and front plan views, respectively, of another embodiment of the hood latch of the present invention in the released position.
Figure 23B:
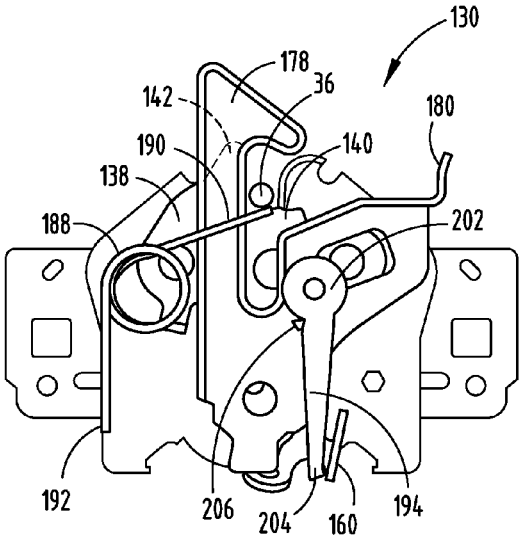
Figure 24:
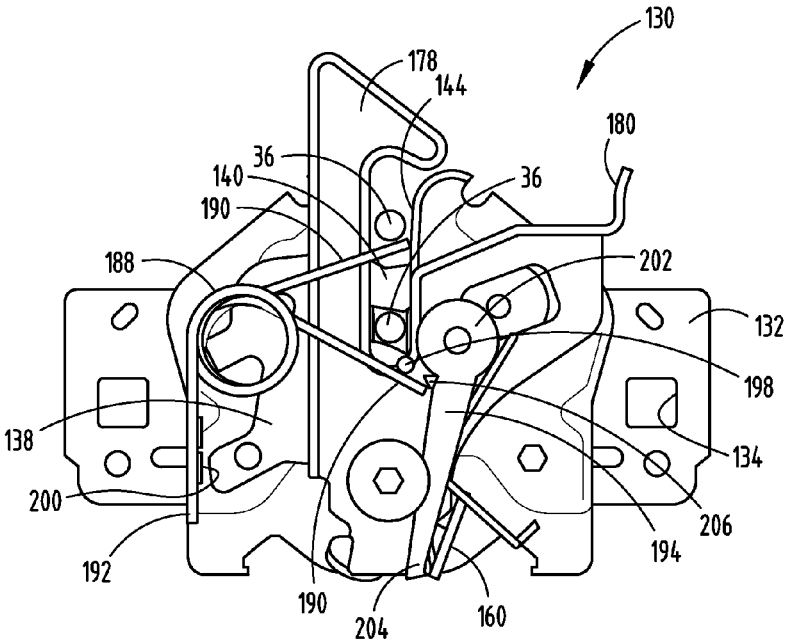
FIG. 24 is a front plan view another embodiment of a hood latch of the present invention in the locked position.

In normal operation, actuation of the bowden cable causes the pawl 152 to rotate, against the force of pawl spring 158, in a clockwise direction to release the pawl engaging tab 150 of the latch 138 from the latch cam engaging surface 154 of the pawl 152, as shown in FIG. 23A. With the latch 138 now free to rotate under the urging the latch spring 162, an arcuate bottom surface 172 of the latch 138 urges the striker 36 upwardly within the channel 144. Once the striker 36 reaches the top of the channel 144 and is essentially free of the latch 138, the striker 36 engages a secondary latch 178, which is normally held in the latched position. In a manner similar to that of the first embodiment, a vehicle operator must then go to the front of the vehicle and manually operate the secondary latch handle 180 to free the striker 36 from the secondary latch 178 and allow the hood to be raised.

Figure 18:
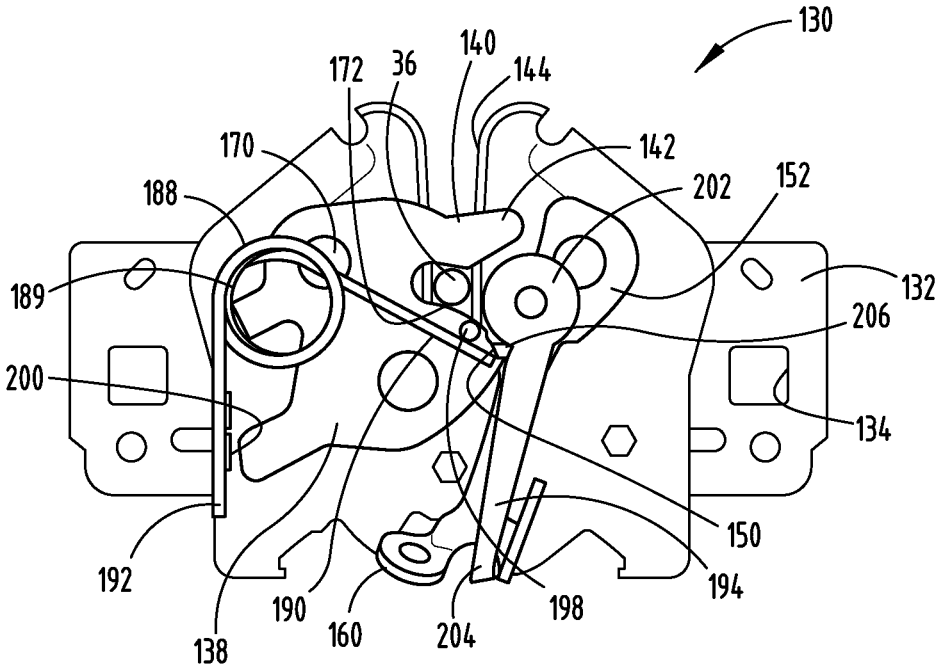
FIG. 18 is a front plan view of certain components of another embodiment of the hood latch of the present invention in the locked position.
Figure 19:
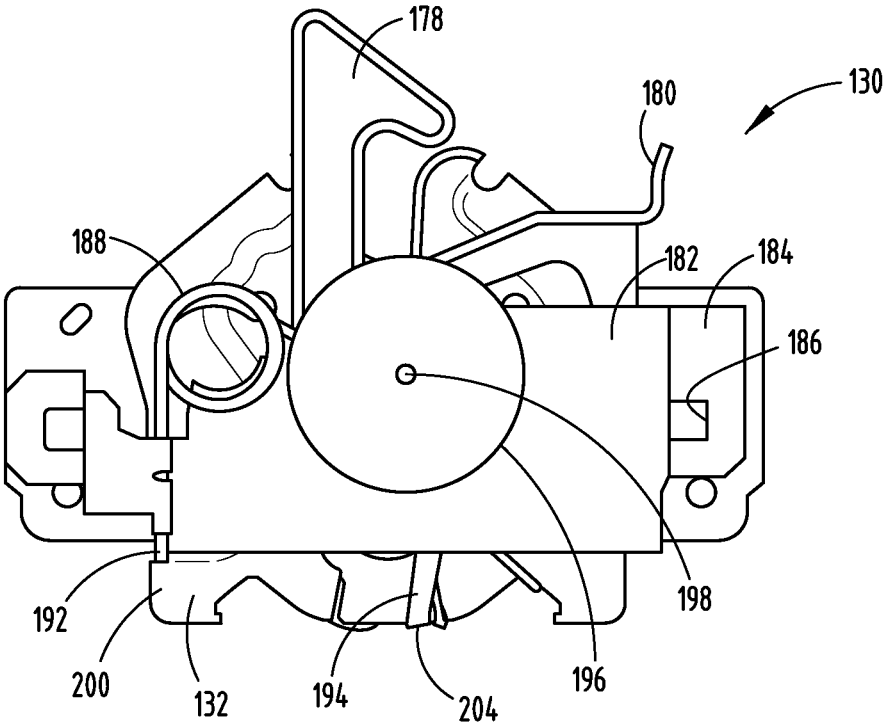
FIG. 19 is a front plan view of the attachable deployment module of another embodiment of the hood latch of the present invention in the locked position.
Figure 20:
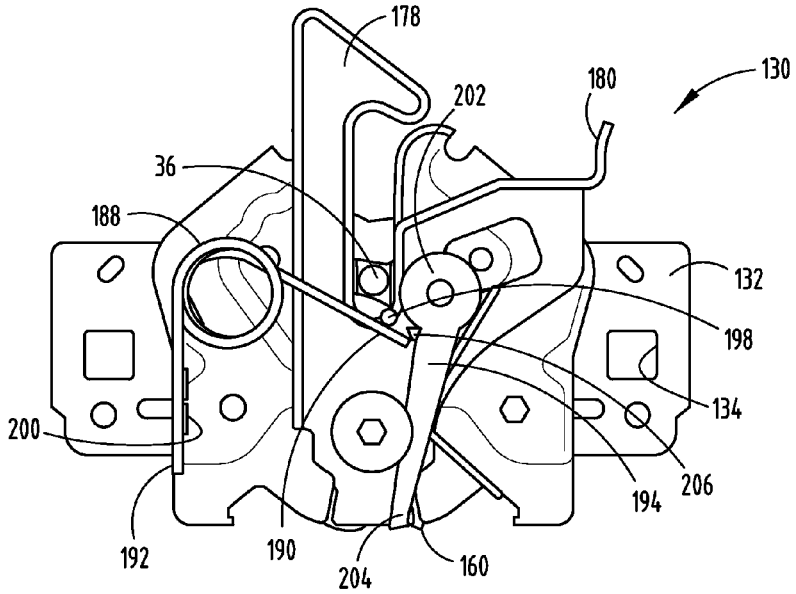
FIG. 20 is a front plan view of certain components of another embodiment of the hood latch of the present invention in the locked position.
Figure 21A:
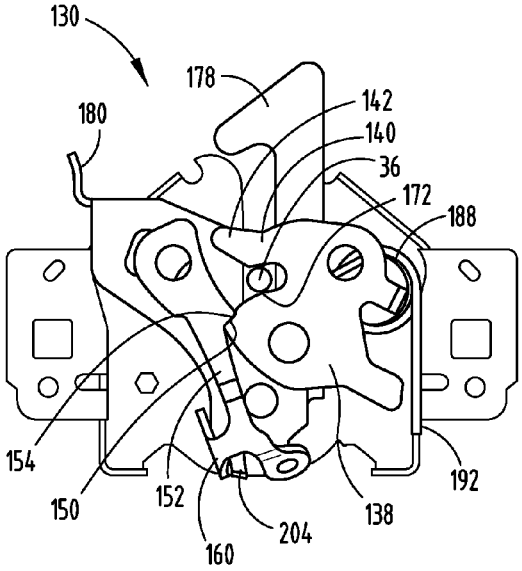
FIGS. 21A-21B are rear and front plan views, respectively, of another embodiment of the hood latch of the present invention in the locked position.
Figure 21B:
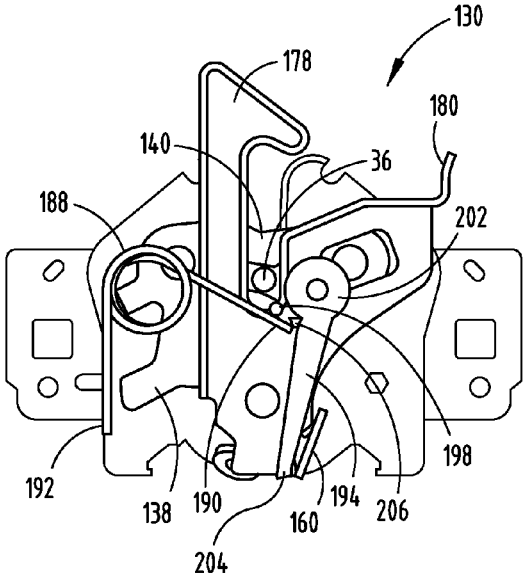

In the context of the present disclosure, the latch assembly 130 is likewise provided with an add-on deployment module 182 that causes the latch assembly 130 to release the striker 36 for engagement with the secondary latch 178 in the raised position in the event of a pedestrian impact. As with the previous embodiment, the deployment module 182 is adapted to be attached to the existing base for interaction with the existing latch structure to obtain the benefits of the present invention. Thus, the attachment bracket 184 is likewise equipped with mounting holes 186 that line up with mounting holes 134 in the latch bracket 132. The deployment module 182 likewise includes a torsion deployment spring 188 having an upper leg 190 and a lower leg 192 mounted about a spring bushing 189, as shown in FIG. 18. The lower leg 192 is restrained by a spring retainer 200 provided on the attachment bracket 184 and the upper leg 190 is restrained in an energize state against the retractable holding pin 198 which is connected to the solenoid 196 directly or via a lever mechanism, also attached to the attachment bracket 184 (the upper leg 190 is shown in both the energized and released states in FIG. 24). A pawl release lever 194 similarly has a circular portion 202 that is pivotably mounted to the attachment bracket 184 and an extending portion 204 depending therefrom. The circular portion 202 of the pawl release lever 194 is also provided with release cam 206 that interacts with the upper leg 190 of the deployment spring 188.

Figure 22A:
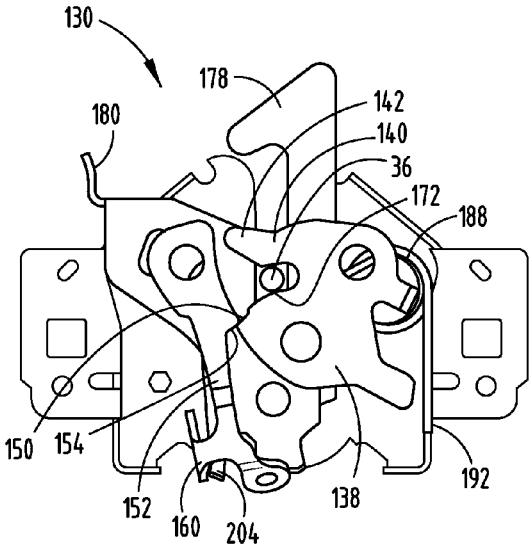
FIGS. 22A-22B are rear and front plan views, respectively, of another embodiment of the hood latch of the present invention in the locked position.
Figure 22B:
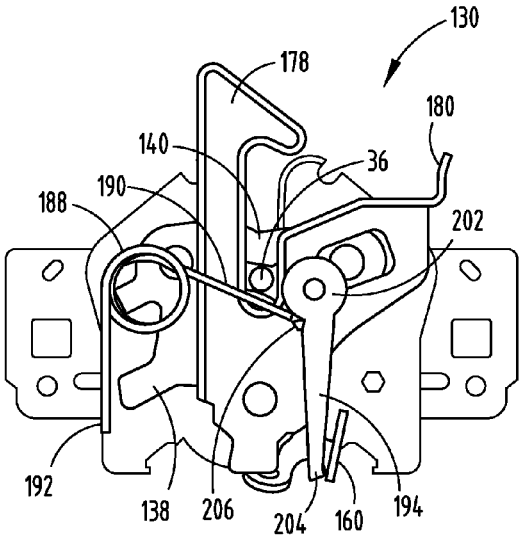

As shown in FIGS. 21A-23B, in the event of an impact with a pedestrian, the holding pin 198 is retracted, thereby causing the upper leg 190 of the deployment spring 188 to act on the release cam 206 of the pawl release lever 194, thereby placing the pawl release lever 194 in the released position, best shown in FIG. 22B. This, in turn, releases the pawl 152 from the latch 138 as described above and allows the latch 134 to rotate to the released position. The upper leg 190 of the deployment spring 188 further acts directly on the striker 36 to urge the striker 36 upwardly within the channel 144 until the striker 36 encounters the secondary latch 178, which thus then retains the hood in a partially raised position. The raised hood, however, provides the beneficial benefits of the present invention and provides displacement within which the hood might be used to absorb the energy of the pedestrian's head with the motor vehicle.

As noted above, in the event of a collision between the vehicle 10 and a pedestrian 80, injury to the pedestrian 80 is minimized if the vehicle hood 12 is unlatched and partially open when the pedestrian 80 comes into contact with the top surface of the vehicle hood 12. The crash sensors 78 act as a trigger in the event of a pedestrian collision. Alternatively, one or more crash sensors 78 may be positioned about the vehicle body to detect a rapid deceleration of the vehicle or if a portion of a pedestrian 80 comes into contact with the vehicle 10 during operation. In each of the above embodiments, determining the presence of a pedestrian may be accomplished by crash sensors 78 of various types, such as radar, proximity sensors, contact sensors, or any other device capable of determining the presence of a pedestrian in front of the motor vehicle. Preferably, radar systems presently used to warn drivers of an impending frontal collision and to control the distance between vehicles using automatic cruise control may be used to generate a signal in response to the pedestrian in front of the motor vehicle when the vehicle is in forward motion.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A motor vehicle hood latch mechanism for engaging a striker disposed proximate an edge of a hood having a closed locked position and a released position, the mechanism comprising:

a latch assembly attached to a chassis member of the motor vehicle and adapted to releasably engage the striker to restrain the hood in the closed locked position, the latch assembly including a latch having a locking cam and a pawl movable between a locked position engaging the locking cam, wherein the latch secures the striker to restrain the hood in the closed locked position, and an unlocked position away from the locking cam, wherein the latch allows the hood to move to the released position, a sensor for detecting the presence of a pedestrian proximate the front of the motor vehicle and generating a signal in response thereto;

a resilient member comprising a torsion spring having a center spring coil, an upper leg extending from an upper portion of the center spring coil and a lower leg extending from a lower portion of the center spring coil, the resilient member having an energized position and a released position operatively coupled to the pawl and the resilient member being retained in the energized position by a release mechanism responsive to the signal generated by the sensor, and a latch engagement stud mounted to the latch for engagement with one of the upper and lower torsion spring legs and a latch pivot bolt about which the latch rotates and about which the center spring coil is mounted, wherein the release mechanism comprises a solenoid coupled to a holding pin to hold one of the upper and lower torsion spring legs in the energized position, and wherein activation of the solenoid in response to the signal generated by the sensor releases the torsion spring to the released position and the torsion spring rotates the pawl to the unlocked position and releases the one of the upper and lower torsion spring legs for engagement with the latch engagement stud to rotate the latch to place the hood in the released position.

2. The motor vehicle hood latch mechanism of claim 1 further comprising a secondary latch restraining the hood from opening beyond the released position subsequent rotation of the pawl to the unlocked position.

3. The motor vehicle hood latch mechanism of claim 2 further comprising a secondary latch release handle operatively coupled with the secondary latch.

4. The motor vehicle hood latch mechanism of claim 1, wherein the latch comprises an upper segment having a transverse portion and a depending portion for engaging the striker and a lower segment to which the latch engagement stud is mounted, wherein when the latch is rotated to allow the hood to move to the released position, the striker is engaged by the depending portion of the upper segment to limit the hood from opening beyond the released position.

5. The motor vehicle hood latch mechanism of claim 4 further comprising a secondary latch release lever and wherein the latch further comprises a secondary latch release pawl engaging tab for selective engagement with the pawl, wherein the latch secures the striker to restrain the hood from opening beyond the released position and wherein operation of the secondary latch release lever further rotates the pawl so as to release the secondary latch release pawl engaging tab on the latch to completely disengage the latch from the striker for fully opening the hood.

6. The motor vehicle hood latch mechanism of claim 1 further comprising a pawl release lever operatively coupled with the pawl and a cam on the pawl release lever, wherein the one of the upper and lower torsion spring legs acts directly on the cam on the pawl release lever to rotate the pawl release lever, and to rotate the pawl to the unlocked position.

7. The motor vehicle hood latch mechanism of claim 6, wherein the one of the upper and lower torsion spring legs also acts directly on the latch engagement stud to rotate the latch and place the hood in the released position.

8. The motor vehicle hood latch mechanism of claim 1, wherein the torsion spring and solenoid are mounted to a module base attached to the latch assembly, the torsion spring being disposed about a spring mounting bushing in axial alignment with the latch pivot bolt about which the latch rotates, such that the lower leg of the torsion spring is disposed proximate the latch engagement stud and the upper leg of the torsion spring is restrained by the module base.

9. The motor vehicle hood latch mechanism of claim 1 further comprising a pawl release lever operatively coupled with the pawl and a cam on the pawl release lever, wherein the resilient member acts directly on the cam on the pawl release lever to rotate the pawl release lever and the pawl to the unlocked position, and wherein the resilient member also acts directly on the latch engagement stud to rotate the latch to place the hood in the released position.

10. The motor vehicle hood latch mechanism of claim 1 further comprising a primary release lever operatively connected to the pawl, a pawl release lever operatively coupled with the pawl and a cam on the pawl release lever, wherein the resilient member acts directly on the cam on the pawl release lever to rotate the pawl release lever and the pawl to the unlocked position, and wherein the pawl release lever also acts on the primary release lever to rotate the latch to place the hood in the released position.

11. The motor vehicle hood latch mechanism of claim 1 further comprising a pawl release lever operatively coupled with the pawl and a cam on the pawl release lever, wherein the resilient member acts directly on the cam on the pawl release lever to rotate the pawl release lever and the pawl to the unlocked position, and to rotate the latch to place the hood in the released position.

12. An add-on deployment module for attachment to a latch assembly for a motor vehicle hood latch mechanism having a striker disposed proximate an edge of a hood having a closed locked position and a released position, wherein the latch assembly is attached to a chassis member of the motor vehicle and is adapted to releasably engage the striker to restrain the hood in the closed locked position, the latch assembly including a latch having a locking cam and a pawl movable between a locked position engaging the locking cam, wherein the latch secures the striker to restrain the hood in the closed locked position, and an unlocked position away from the locking cam, wherein the latch allows the hood to move to the released position, the motor vehicle further having a sensor for detecting the presence of a pedestrian proximate the front of the motor vehicle and generating a signal in response thereto, the module comprising:

a module base;

a release mechanism;

a resilient member comprise a torsion spring in direct contact with the latch and having an energized position and a released position, the resilient member being retained in the energized position by the release mechanism responsive to the signal generated by the sensor, such that actuation of the release mechanism releases the resilient member; and a pawl release lever operatively coupled to the pawl and a cam on the pawl release lever, wherein the resilient member, release mechanism and pawl release lever are mounted to the module base attached to the latch assembly, such that the resilient member acts on the cam on the pawl release lever to rotate the pawl release lever and the pawl to the unlocked position, and to rotate the latch to place the hood in the released position.

13. A motor vehicle hood latch mechanism for engaging a striker disposed proximate an edge of a hood having a closed locked position and a released position, the mechanism comprising:

a latch assembly attached to a chassis member of the motor vehicle and adapted to releasably engage the striker to restrain the hood in the closed locked position, the latch assembly including a latch having a locking cam and a pawl movable between a locked position engaging the locking cam, wherein the latch secures the striker to restrain the hood in the closed locked position, and an unlocked position away from the locking cam, wherein the latch allows the hood to move to the released position;

a sensor for detecting the presence of a pedestrian proximate the front of the motor vehicle and generating a signal in response thereto;

a resilient member having an energized position and a released position operatively coupled to the pawl, the resilient member being retained in the energized position by a release mechanism responsive to the signal generated by the sensor, such that actuation of the release mechanism releases the resilient member and rotates the pawl to the unlocked position to place the hood in the released position; and a pawl release lever operatively coupled with the pawl and a cam on the pawl release lever, wherein the resilient member acts directly on the cam on the pawl release lever to rotate the pawl release lever and the pawl to the unlocked position, and wherein the resilient member also acts directly on a latch engagement stud mounted to the latch to rotate the latch to place the hood in the released position.

* * * * *